US006181277B1

(12) United States Patent
Kesler et al.

(10) Patent No.: US 6,181,277 B1
(45) Date of Patent: Jan. 30, 2001

(54) MICROSTRIP ANTENNA

(75) Inventors: Oren Byrl Kesler; Thomas Stanley Watson, both of Richardson, TX (US)

(73) Assignee: Raytheon Company, Lexington, MA (US)

( * ) Notice: Under 35 U.S.C. 154(b), the term of this patent shall be extended for 0 days.

(21) Appl. No.: 07/464,660

(22) Filed: Jan. 11, 1990

Related U.S. Application Data

(63) Continuation of application No. 07/326,408, filed on Mar. 20, 1989, now abandoned, which is a continuation of application No. 07/035,830, filed on Apr. 8, 1987, now abandoned.

(51) Int. Cl.[7] ..... H01Q 3/02
(52) U.S. Cl. ..... 343/700 MS
(58) Field of Search ..... 343/700 MS, 705, 343/830, 769, 767; 342/2

(56) References Cited

U.S. PATENT DOCUMENTS

| | | | | |
|---|---|---|---|---|
| 4,138,684 | * | 2/1979 | Kerr | 343/700 MS |
| 4,170,013 | * | 10/1979 | Black | 343/700 MS |
| 4,218,682 | * | 8/1980 | Yu | 343/700 MS |
| 4,320,402 | * | 3/1982 | Bowen | 343/700 MS |
| 4,369,447 | * | 1/1983 | Edney | 343/700 MS |
| 4,510,498 | * | 4/1985 | Mori et al. | 343/700 MS |
| 4,605,932 | * | 8/1986 | Butscher et al. | 343/700 MS |
| 4,660,048 | * | 4/1987 | Doyle | 343/700 MS |
| 4,733,245 | * | 3/1988 | Mussler | 343/769 |
| 4,783,661 | * | 11/1988 | Smith | 343/700 MS |

FOREIGN PATENT DOCUMENTS

| | | | | |
|---|---|---|---|---|
| 0174068 | * | 3/1986 | (EP) | 343/700 MS |
| 2005922 | * | 4/1979 | (GB) | 343/700 MS |
| 0059605 | * | 4/1983 | (JP) | 343/700 MS |

* cited by examiner

*Primary Examiner*—Theodore M. Blum
(74) *Attorney, Agent, or Firm*—Baker Botts L.L.P.

(57) ABSTRACT

A dual frequency antenna is mounted into a ground plane with an opening having a first predetermined length and width and under which a container having a second length, width and also depth is mounted. The dimensions of the opening and container are selected according to the operating characteristics of the antenna. The container includes four sides and a bottom plate. A first microstrip element is mounted in the container in alignment with the ground plane in the opening and it has a length and width less than the first predetermined length and width. The second length and width of the microstrip element is selected to optimumly perform at a first operating frequency. A second microstrip element is mounted in the container and is separated from the bottom plate by a preselected difference and separated from the first plate by a second preselected distance and its operating frequency is selected to be less than the first operating frequency. A plurality of feed probes having an appropriate phase arrangement are connected to the first microstrip element. A power divider network is operatively connected to the feed probes and either conducts to or receives power from the feed probes.

23 Claims, 2 Drawing Sheets

MICROSTRIP ANTENNA

This application is a Continuation, of application Ser. No. 07/326,408, filed Mar. 20, 1989, now abandoned.

This application is a Continuation of application Ser. No. 07/035,830, filed Apr. 8, 1987, now abandoned.

BACKGROUND OF THE INVENTION

This invention relates to antennas and more particularly to microwave antennas that are used in a global positioning system.

A global positioning system (GPS) requires the use of a dual frequency circularly polarized antenna. GPS antennas range from fixed beam antennas to phased arrays to adaptive arrays. A common feature for all GPS antenna systems is an antenna element with the following requirements: dual frequency operation of a low frequency $F_l$ having a low central frequency of 1.227 Ghz, a high frequency $F_h$ having a high central frequency of 1.575 Ghz.

The bandwidth for both $F_l$ and $F_h$ is 20 Mhz. Polarization is right hand circular, axial ratio is not specified, the coverage is hemispherical, and the gain at 0° is 0.0 dBci and at 80° a −6.0 dBci.

Antenna elements that can meet these requirements are (1) dual frequency microstrip patch elements, (2) spiral elements and (3) volute elements. In some applications, there is an additional requirement for an antenna element with a low monostatic scattering in the region of 45° to 90° from zenith. Typical frequencies for the low monostatic scatterings are 500 Mhz to 18 Ghz.

The volute antenna element with a high profile has unacceptable monostatic scattering and therefore, does not satisfy the above stated requirements.

FIGS. 7 and 8 are illustrations showing a dual frequency microstrip patch antenna element of the prior art system and in particular a ground plane 7 is provided over which a low profile antenna element that includes a first microstrip patch 1 and a second microstrip patch 3 is mounted. Terminals 9 and 5 connect the dual frequencies between the antenna element and a receiver (not shown). In the embodiment of FIG. 8, the microstrip patch 1 is separated from the ground plane 7 by a honeycomb spacer 11. Similarly, the microstrip patch 3 is separated from the microstrip patch 1 via honeycomb spacer 13. The overall assembly is covered by a nonconductive radome 15.

The antenna element in FIGS. 7 and 8 has a moderate profile above the ground plane 7 and accordingly this antenna does not have low monostatic scattering.

The prior art spiral element antenna has marginal gain and does not meet the scattering requirement. A commonly used approach to reduce monostatic scattering for an antenna element is to recess the element into the ground plane and to cover the element with sufficient microwave absorbing material. However, this approach excessively reduces the antenna gain.

SUMMARY OF THE INVENTION

A dual frequency antenna is mounted into a ground plane with an opening having a first predetermined length and width and under which a container having a second length, width and also depth is mounted. The dimensions of the opening and container are selected according to the operating characteristics of the antenna. The cavity includes four sides and a bottom plate. A first microstrip element is mounted in the container in alignment with the ground plane in the opening and it has a length and width less than the first predetermined length and width. The second length and width of the microstrip element is selected to optimumly perform at a first operating frequency. A second microstrip element is mounted in the container and is separated from the bottom plate by a preselected difference and separated from the first microstrip element by a second preselected distance and its operating frequency is selected to be less than the first operating frequency. A plurality of feed probes having an appropriate phase arrangement are connected to the first microstrip element. A power divider network is operatively connected to the feed probes and either conducts to or receives power from the feed probes.

The dual frequency antenna has a dielectric material in the container between the first microstrip element and second microstrip element and between the second microstrip element and the bottom plate. The dual frequency feed probes are brought in to maintain a 90° phase shift between each feed probe.

The first microstrip element is centrally positioned in the opening in the ground planes such that the separation between the edge of the first plate and the opening is equal to one half the difference between the first length and the second length.

It is the object of the invention to provide a dual element antenna that reduces scattering from the structure of the antenna and provides for an antenna that is flush mounted within a conductive ground plane and uses higher dielectrics than air in the inner part of the antenna element which is preferably higher than 2.0 dielectric coefficients.

It is another object of the invention to provide a dual element antenna which reduces monostatic scattering and includes a dual element antenna in which the dual elements are designed to have a narrow bandwidth with each element being design at an optimum frequency rather than a single band that covers both frequencies.

It is yet another object to provide additional monostatic scattering reduction in an antenna system in which a dual element antenna is flushed mounted within a conductive ground plane and is covered with a thin layer of magnetic microwave absorber.

These and other features and advantages of the invention will become more apparent from a reading of the specification in conjunction with the drawings in which:

DETAILED DESCRIPTION OF THE PREFERRED EMBODIMENTS

Figure 1:
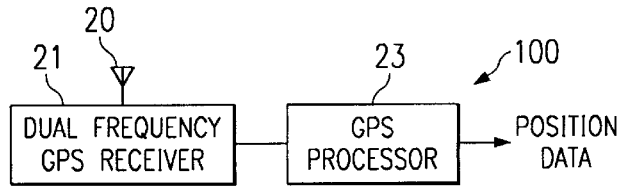
FIG. 1 is a block diagram of a GPS receiver.
Figure 2:
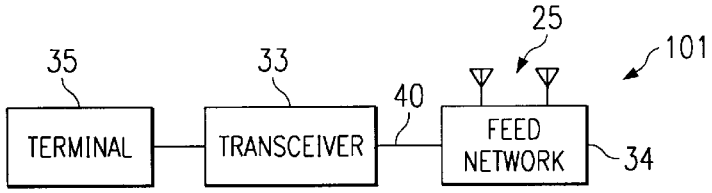
FIG. 2 is a second embodiment of a GPS receiver.

A GPS system such as that of FIGS. 1 and 2 determines the position and time of a receiver 100 or 101 by receiving coded signals from four satellites (not shown). The time of arrival of the measure signals from the satellites is used to determine position and time of the receivers 100 and 101. However, these signals are affected by the atmospheric conditions in a deterministic manner, electron density, time of day, sun spot activity, and location on the earth and thus the location determination is also affected. By making the measurements in two frequencies, the deterministic effect of the atmospheric conditions can be compensated for and thus the system accuracy can be sufficiently improved.

Specifications defining these two frequencies are available from the United States Government and are entitled: "Nav Star Global Positioning System" No: SS-GPS-300D and "System Segment Specification for User System Segment" No: SS-US-200.

Referring to FIG. 1, a dual frequency antenna 20 receives the radio frequency information which is processed and downconverted by a dual frequency GPS receiver 21. The down converted received information is passed to a GPS processor 23 which obtains the position data based upon the characteristics defined above.

In the embodiment of FIG. 2, a dual frequency antenna 25 receives two frequencies $F_h$ and $F_l$. The two received signals are vectorally combined in a feed network 34 and down converted by a transceiver 33 to provide output data via terminal 35. This data may be used to accurately pinpoint the location of the dual antenna 25.

Figure 3:
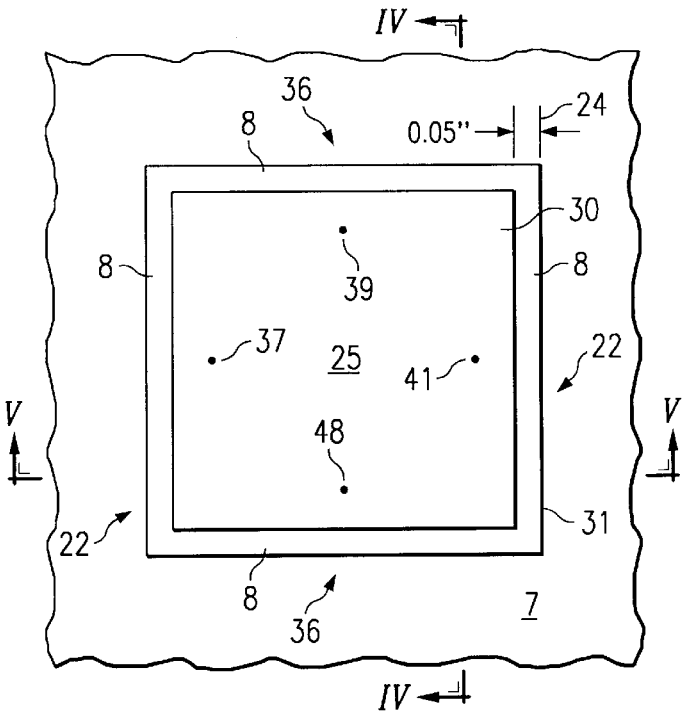
FIG. 3 is a top view of a dual frequency antenna according to the invention.

FIG. 3 to which reference should now be made is a top view of the antenna 25. The antenna 25 is mounted on a ground plane 7 which has an opening around the edges 31 having a width 22 and a length 36 selected according to the desired frequency characteristics of the dual frequency antenna 25. A top microstrip patch element 30 such as a thin copper plate or other conductive material is flush mounted with the ground plane 7 and has a width and length less than the width and length of the opening in the ground plane 7 such that in each direction the separation 8 between the opening of the ground plane 7 and the edges of the microstrip 30 is ½ the difference between the lengths and widths. This separation in the embodiment of FIG. 3 is 0.05 inches as is illustrated by dimension lines 24. This 0.05 inches is maintained around the circumference of the opening in the ground plane 7. Four feed throughs 37, 39, 41 and 48 are electrically connected between the top microstrip patch element 30 and the feed network 34 (FIG. 6).

Figure 4:
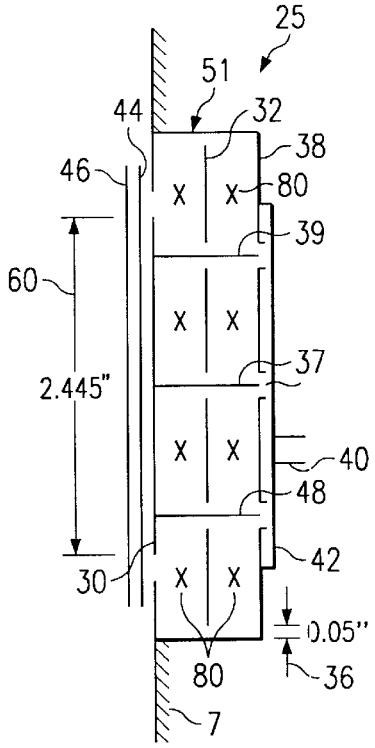
FIG. 4 is a sectional view of the antenna of FIG. 3 as seen from section lines IV—IV.

FIG. 4 is a side view as seen from dimension lines IV—IV and shows a conductor 40 that connects the transceiver 33 to the feed network 34 (both shown in FIG. 6) and is carried into a feed network housing 42. The feed network housing 42 houses the feed network 34. Although a GPS antenna is used primarily as a receiving antenna it works equally well as a transmitting antenna and the feed network may be readily explained and understood by discussing a transmit mode of operation. However in the receive mode, the operation is reversed, i.e. rather than dividing the feed network combines the output from the four feed probes. In the transmit mode of operation, the feed network 34 divides the radio signal to be transmitted into four components for connecting to the feed through probes that terminate on the top microstrip patch element 30 at 37, 39, 41 and 48. Separating the top microstrip patch element 30 from a bottom ground plane 38 is a second microstrip patch element 32 such as a thin copper plate or other conductive material which is larger than the microstrip patch element 30 and is electrically isolated from the sides of a container 51 that houses the antenna assembly by a space represented by dimension lines 36. In the embodiment of FIG. 4, this space of course is 0.05 inches.

Figure 5:
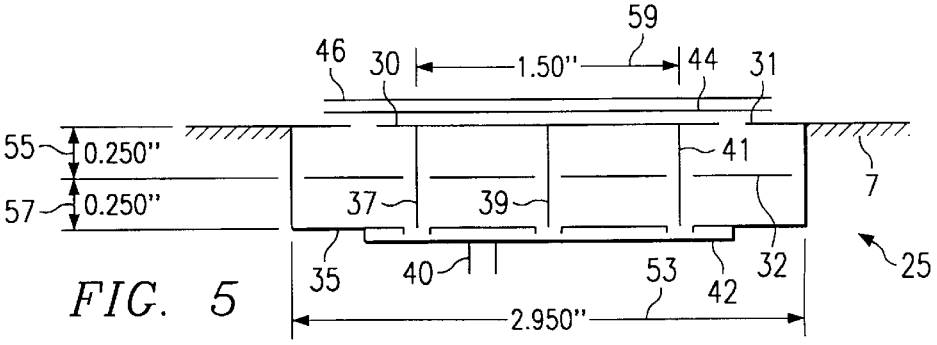
FIG. 5 is a sectional view of the antenna as seen from dimension lines V—V showing the dimensions of an embodiment of the antenna according to the invention.

Referring to FIG. 5 which is a sectional view as seen from dimension lines V—V, the length of the container 51 in the embodiment of FIG. 5 is provided by dimension lines 53 and the width of course is the same because the container 51 has square sides. The separation between the top ground plane and the microstrip patch element 32 is provided by dimension lines 55 and the separation between the microstrip patch element 32 and the bottom of the container 51 is provided by dimension line 57. The container 51 is electrically connected to the ground plane 7 and in the case of FIG. 5 is also a conductive box. The spacing between the probe 41 and 37 is provided by dimension line 59. The radiation slot which is the difference in the diameter of the microstrip patch element 30 and the edges 31 of the ground plane 7 and the radiation slot is covered by a thin membrane 46. This thin membrane 46 is a microwave absorber whose thickness is typically 20 to 50 mils with a thin 5 to 10 mils dielectric spacer 44 such as mylar between the microstrip patch element 30 and the microwave absorber 46 which protects the antenna element from rain erosion. If the absorber is not used, then a thin dielectric layer over the radiation slot will suffice for rain erosion and prevent the detuning of the element 30 by the weather conditions.

Figure 6:
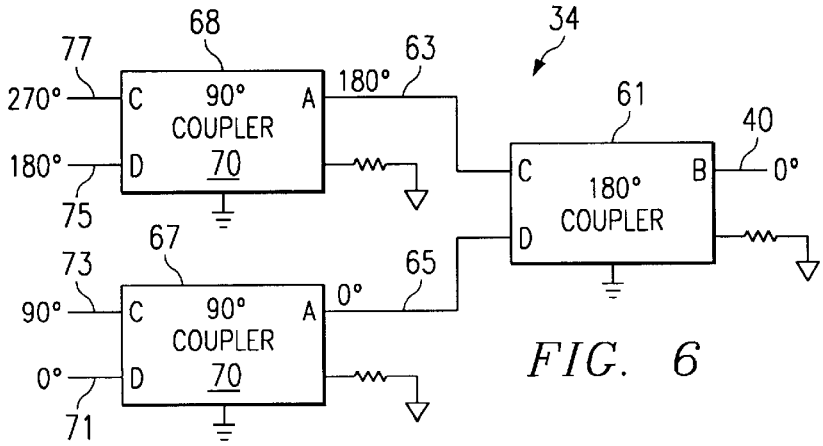
FIG. 6 is a schematic diagram of a power coupler that is used to couple signals to and from the antenna according to the invention.
Figure 7:
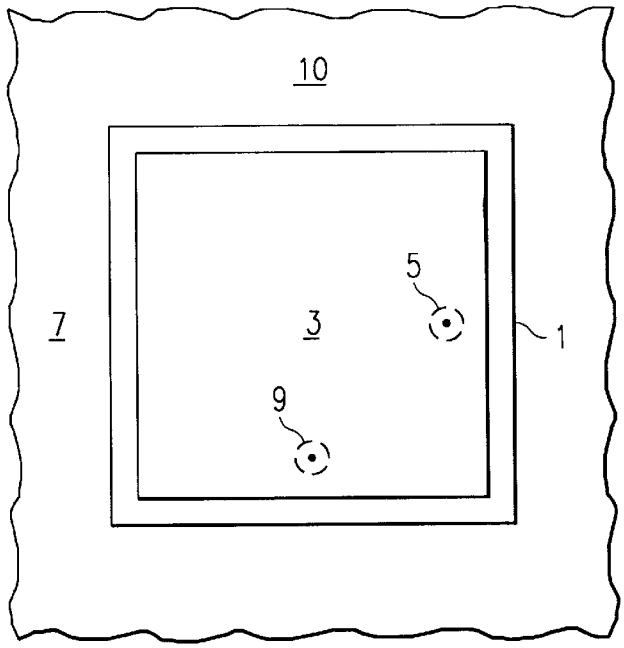
FIG. 7 (PRIOR ART)
FIG. 7 is a top view of a prior art antenna.
Figure 8:
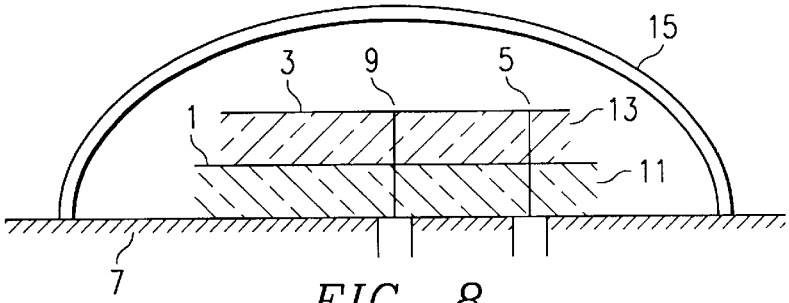
FIG. 8 (PRIOR ART)
FIG. 8 is a side view of the prior art antenna.

Referring to FIG. 6, the feed network consists of three hybrid couplers with a first hybrid coupler 61 providing 180° phase shift to any signal that is applied thereto at conductor 40 or vectorally combined any received signals via conductors 63 and 65. In addition to the single 180° coupler 61, there are two 90° couplers 70. The first 90° coupler 67 provides two outputs, a 0° output and a 90° output or vectorally combines signals on the 0° input and 90° input applied thereto via conductors 71 and 73. A second 90° coupler 68 has inputs to receive a 180° signal and a 270° signal via conductors 75 and 77 respectively. The hybrid couplers 70 separate the signal present on terminal A into two signals that have a 90° phase relationship on terminals C and D or vectorally combine at 90° the signals on terminals C and D to a single signal on the terminals A. Therefore there is a 270° phase relationship between signals on conductor 77 and 40; a 180° phase relationship between signals on conductor 75 and 40; a 90° phase relationship between signals on conductor 73 and 40; and a 0° phase relationship between signals on conductor 71 and 40.

The antenna 25 of FIGS. 3, 4 and 5 radiates with a right hand circular polarization electromagnetic energy at 1.227 Ghz and 1.575 Ghz and has at least a 20 Mhz bandwidth at each frequency. The coupling network 90 of FIG. 6 consists of two 90° 3 dB coupler 70 and 180° 3 dB coupler 44 and feeds the four probes 37, 39, 41 and 48 with the appropriate phase to achieve the circular polarization. The three couplers and four probes are used to guarantee a symmetrical excitation and thus improve overall performance over a wider band.

The dual frequency antenna 25 is flush mounted within the ground plane 7. The outer metallic surface of the antenna lies in the surface of the ground plane for the highest possible structural monostatic scattering reduction. A separate radome is not required for the flush mounted antenna. To minimize the monostatic scattering, there is only one narrow slot 8 in the ground plane even though the antenna supports two frequencies. The critical dimensions for the above defined frequencies are provided in FIGS. 3 and 5 and provide ability to the antenna to support the dual of frequencies. The dual frequency antenna 25 size can be reduced and the monostatic scattering lowered by the use of a spacer 80 of a low loss material with a high dielectric constant. Both the first microstrip 30 and second microstrip 32 may be deposited on the spacer 80. As was stated, a thin dielectric layer, such as 20 to 50 mils of mylar or polyurethane paint covers the antenna at 41. For additional monostatic scattered reduction, a 10 to 15 mil layer magnetic absorber 46 can be applied. This improves the low angle scattering and is effective at high frequency where the dual frequency antenna 25 may have resonances. The performance of the dual frequency antenna 25 using the dimensions of FIGS. 3 through 5 provided an antenna in which the two frequencies exceed the required bandwidth. Additionally, there was a 4 dBci and 5.5 dBci gain at the bore sight for $F_l$ and $F_h$ respectively. The antenna elements substantially reduce the monostatic scattering in the region of 20° to 90° from zenith.

What is claimed is:

1. A microstrip antenna comprising:

(a) a ground plane forming an upper surface;

(b) a bottom portion and side wall portions;

(c) a cavity that extends from said upper surface and is bounded by said bottom portion and said side wall portions;

(d) a first resonant microstrip patch aligned in the plane of the ground plane and positioned above the cavity bottom portion; and (e) a feed probe positioned in the cavity and electrically connected to the first microstrip patch to substantially reduce monostatic scattering.

2. The microstrip antenna of claim 1 further including:

a plurality of additional feed probes each positioned in the cavity bottom portion and electrically connected to the first microstrip patch; and a power dividing network operatively connected to each of the feed probes.

3. The microstrip antenna of claim 1 wherein the cavity is rectangular in shape, having four rectangular side walls and a rectangular bottom portion.

4. The microstrip antenna of claim 1 further including at least one additional resonant microstrip patch mounted in the cavity below and parallel to the first microstrip patch and resonant at a frequency different from said first microstrip patch.

5. The microstrip antenna of claim 1 further including a second resonant microstrip patch mounted in the cavity below and parallel to the first microstrip patch with said second microstrip patch spatially separated from the first microstrip patch and electrically coupled to said feed probes.

6. The microstrip antenna of claim 4 further including:

a plurality of additional feed probes each positioned in the cavity below the microstrip patches, electrically connected to said first microstrip patch and capacitively coupled to the said second microstrip patch; and a power dividing network operatively connected to each of said feed probes.

7. The microstrip antenna of claim 1 further including a second microstrip patch mounted in the cavity below and parallel to said first microstrip patch with said second microstrip patch spatially separated by a dielectric material from said first microstrip patch and capacitively coupled to said feed probe.

8. The microstrip antenna of claim 7 further including:

a plurality of additional feed probes each positioned in the cavity below the microstrip patches, electrically connected to said first microstrip patch and capacitively coupled to the second microstrip patch; and a power dividing network operatively connected to each of said feed probes.

9. The microstrip antenna of claim 1, further comprising the microstrip antenna cover of claim 7.

10. The microstrip antenna of claim 4, further comprising a thin membrane that functions as a microwave absorber over said antenna and a thin dielectric layer over the thin membrane that reduces effects caused by weather conditions, such as rain erosion and the detuning of the antenna.

11. The microstrip antenna of claim 5, further comprising a thin membrane that functions as a microwave absorber over said antenna and a thin dielectric layer over the thin membrane that reduces effects caused by weather conditions, such as rain erosion and the detuning of the antenna.

12. The microstrip antenna of claim 6, further comprising a thin membrane that functions as a microwave absorber over said antenna and a thin dielectric layer over the thin membrane that reduces effects caused by weather conditions, such as rain erosion and the detuning of the antenna.

13. The microstrip antenna of claim 1 further including a microwave absorber positioned over said first microstrip patch to further reduce the monostatic scattering.

14. The microstrip antenna according to claim 13 wherein said microwave absorber is magnetic.

15. A microstrip antenna comprising:

a ground plane forming an upper surface with an opening therein and having a cavity that extends from said upper surface and is bounded by a bottom portion and side wall portions, a first microstrip patch resonant at a first frequency and aligned in the plane of the ground plane and positioned above the cavity bottom portion, a second microstrip patch which is larger than said first microstrip patch and resonant at a second frequency, said second microstrip patch mounted in the cavity below and parallel to said first microstrip patch, a plurality of feed probes passing through said cavity bottom portion and electrically coupled to said first and second microstrip patches, whereby said antenna substantially reduces monostatic scattering as well as remains tuned at said first and second frequencies within said cavity during operation thereof.

16. The microstrip antenna according to claim 15 wherein said first frequency is greater than said second frequency.

17. The microstrip antenna according to claim 15 further including a dielectric material having a dielectric constant greater than 2.0 between said first and second microstrip patches and between said second microstrip patch and said bottom portion.

18. The microstrip antenna according to claim 15 further including a microwave absorber positioned over said first microstrip patch.

19. The microstrip antenna according to claim 18 wherein said microwave absorber is magnetic.

20. The microstrip antenna according to claim 18 further including a dielectric spacer between said absorber and said first microstrip patch.

21. The microstrip antenna according to claim 15 wherein said first microstrip patch is smaller than said second microstrip patch and a slot is formed between said ground plane and said first microstrip patch.

22. The microstrip antenna according to claim 15 wherein said plurality of feed probes maintain a preselected phase shift therebetween.

23. The microstrip antenna according to claim 22 wherein said phase shift is 90°.

* * * * *